US006959526B2

(12) United States Patent
Sting

(10) Patent No.: US 6,959,526 B2
(45) Date of Patent: Nov. 1, 2005

(54) INSERTER STATION FOR MAIL PROCESSING SYSTEMS

(75) Inventor: Martin Sting, Bad Vibel (DE)

(73) Assignee: Pitney Bowes Deutschland GmbH, Friedberg Hessen (DE)

( * ) Notice: Subject to any disclaimer, the term of this patent is extended or adjusted under 35 U.S.C. 154(b) by 0 days.

(21) Appl. No.: 10/514,146

(22) PCT Filed: May 9, 2003

(86) PCT No.: PCT/EP03/04885

§ 371 (c)(1),
(2), (4) Date: Nov. 8, 2004

(87) PCT Pub. No.: WO03/095232

PCT Pub. Date: Nov. 20, 2003

(65) Prior Publication Data

US 2005/0217210 A1 Oct. 6, 2005

(30) Foreign Application Priority Data

May 10, 2002 (DE) ..... 102 20 908

(51) Int. Cl.[7] ..... B65B 5/02; B65B 61/20
(52) U.S. Cl. ..... 53/569; 53/460; 53/289.3
(58) Field of Search ..... 53/289.3, 460, 53/569; 271/184, 225

(56) References Cited

U.S. PATENT DOCUMENTS 3,858,381 A * 1/1975 Huber et al. ..... 53/569
5,180,154 A * 1/1993 Malick ..... 271/225
5,180,159 A * 1/1993 Malick ..... 271/184
5,413,326 A * 5/1995 Wright ..... 271/225
5,457,941 A * 10/1995 Long et al. ..... 53/460
5,538,239 A * 7/1996 Auerbach et al. ..... 271/225
5,950,399 A * 9/1999 Viens et al. ..... 53/284.3
6,715,755 B2 * 4/2004 Sussmeier ..... 271/251
6,763,648 B2 * 7/2004 Sting et al. ..... 53/284.3

* cited by examiner

*Primary Examiner*—John Sipos
(74) *Attorney, Agent, or Firm*—Michael J. Cummings; Charles R. Malandra, Jr.; Angelo N. Chaclas

(57) ABSTRACT

Disclosed is an inserter station for mail processing systems, consisting of a feeder device (2) for transporting inserts, an envelope separation device for separating envelopes from a stack of envelopes, also comprising a mail transport device (6) which is located parallel to the transport track of the feeder device extending close thereto in order to take up the individual envelopes, further comprising orienting means (30,32) for positioning an envelope to be filled in a precise position in front of an insertion device (35). According to the invention, the complex action of orienting the envelopes to be filled on the path between the envelope separation device (7) and the insertion device (35) is simplified by configuring the envelope transport device (6) at least in one end section adjacent to the intermediate envelope transport device (16) such that the envelope can be horizontally displaced with the aid of a displacement component perpendicular to the direction of transport of the intermediate envelope transport device (16). The intermediate envelope transport device (16) has a direction of transport extending at an angle (alpha) in relation to the direction of transport of the envelope transport device and can extract a transported envelope in an oblique position with respect to the horizontal direction and transport it against an angle stop device (30,32) which can be switched either actively or inactively at random and which in an active position produces a precise orientation of the envelope to be filled with inserts or series of inserts.

23 Claims, 5 Drawing Sheets

INSERTER STATION FOR MAIL PROCESSING SYSTEMS

BACKGROUND OF THE INVENTION

The invention pertains to an envelope-filling station for mail-processing systems,

- having a feeding device for horizontally feeding enclosures or sets of enclosures along a conveying path to a push-in arrangement, which executes an operating stroke in the conveying direction of the conveying path;
- having an envelope-separating arrangement for separating envelopes from an envelope stack and for producing a sequence of separated envelopes;
- having an envelope-conveying device which runs parallel to and alongside the conveying path and is intended for receiving the sequence of separated envelopes and for transferring same to an intermediate envelope-conveying device;
- whereby the intermediate envelope-conveying device transports the envelopes, once they have been received from the envelope-conveying device, essentially in the plane of the conveying path upstream of the push-in arrangement; and
- having aligning means for the positioning of an envelope, which is to be filled in each case, in a precise position upstream of the push-in arrangement.

The person skilled in the art can learn of an envelope-filling station having essentially the features named above from FIG. 1 of DE 100 15 755 C1, for example.

The known design of an envelope-filling station of this type provides that, starting from an envelope-separating arrangement, the envelope-conveying device has a course that is parallel to the conveying path for the conveying of the enclosures or sets of enclosures, and provides at its end aligning means in the form of stops that can be adjusted to the envelope format, in such a way that the intermediate envelope-conveying device, which in the known envelope-filling stations exhibits a conveying direction that is perpendicular to the conveying direction of the conveying path, receives an envelope forwarded by the envelope-conveying device in a precisely aligned state, and by clamping it between an envelope conveyor belt that is directed over an envelope-filling table and a roller strip that can be lowered onto that, transports it, again in a precise position, to upstream of the push-in arrangement and brings it to rest there so that then, after the mentioned roller strip has been lifted, the filling of the envelope with enclosures or sets of enclosures can take place, after which the roller strip is again lowered onto the filled envelope and the envelope conveyor belt is put into operation and a removal of the filled envelope takes place.

It can be seen that with this known design, which is very advantageous per se, considerable industrial complexity and control complexity must be operated for aligning the envelope during the conveying segments in the region of the envelope-conveying device, in the region of the intermediate envelope-conveying device running perpendicular to that, and ahead of the push-in station.

This complexity has been accepted in the past, in particular, because the disposition of the envelope-conveying device situated parallel to and alongside the conveying path for the enclosures and sets of enclosures and at about the same level with this conveying path for adjusting, monitoring and general operation by the operator has proven to be advantageous, since when deployed next to the envelope-separating arrangement and the envelope-conveying device, the operator can also oversee the push-in arrangement and the feeding device for the enclosures or sets of enclosures and can intervene with all of these.

The task of the present invention is to configure an envelope-filling station with the features of the preamble to claim 1 in such a way that while retaining the advantageous positioning possibility for the operator, the complexity for aligning the envelope to be filled on the route between the envelope-separating arrangement and the push-in arrangement is simplified. The envelope-filling station suggested here is also intended to be suitable for elevated working speeds and to be reliable at elevated working speeds of over 12,000 working cycles per hour.

SUMMARY OF THE INVENTION

According to the invention, this problem is solved through the features of the attached claim 1. Advantageous configurations and further developments of such an envelope-filling station form the object of claims which are subordinate to claim 1 and the content of which is hereby expressly made a part of the Description without the wording having to be repeated here.

The invention is based on the knowledge that with coupling between the particular envelope-conveying devices that varies and varies in strength between segments and through provision of an oblique course of a conveying segment, an aligning of the envelope relative to two coordinate axes can finally take place simultaneously in a single working cycle upstream of the push-in arrangement, without a precise preliminary alignment having to take place in advance on intermediate segments of the envelope conveying.

DESCRIPTION OF THE DRAWINGS

In the following, several embodiments are described in more detail with the aid of a drawing. The following are shown.

DETAILED DESCRIPTION OF THE INVENTION

Figure 1:
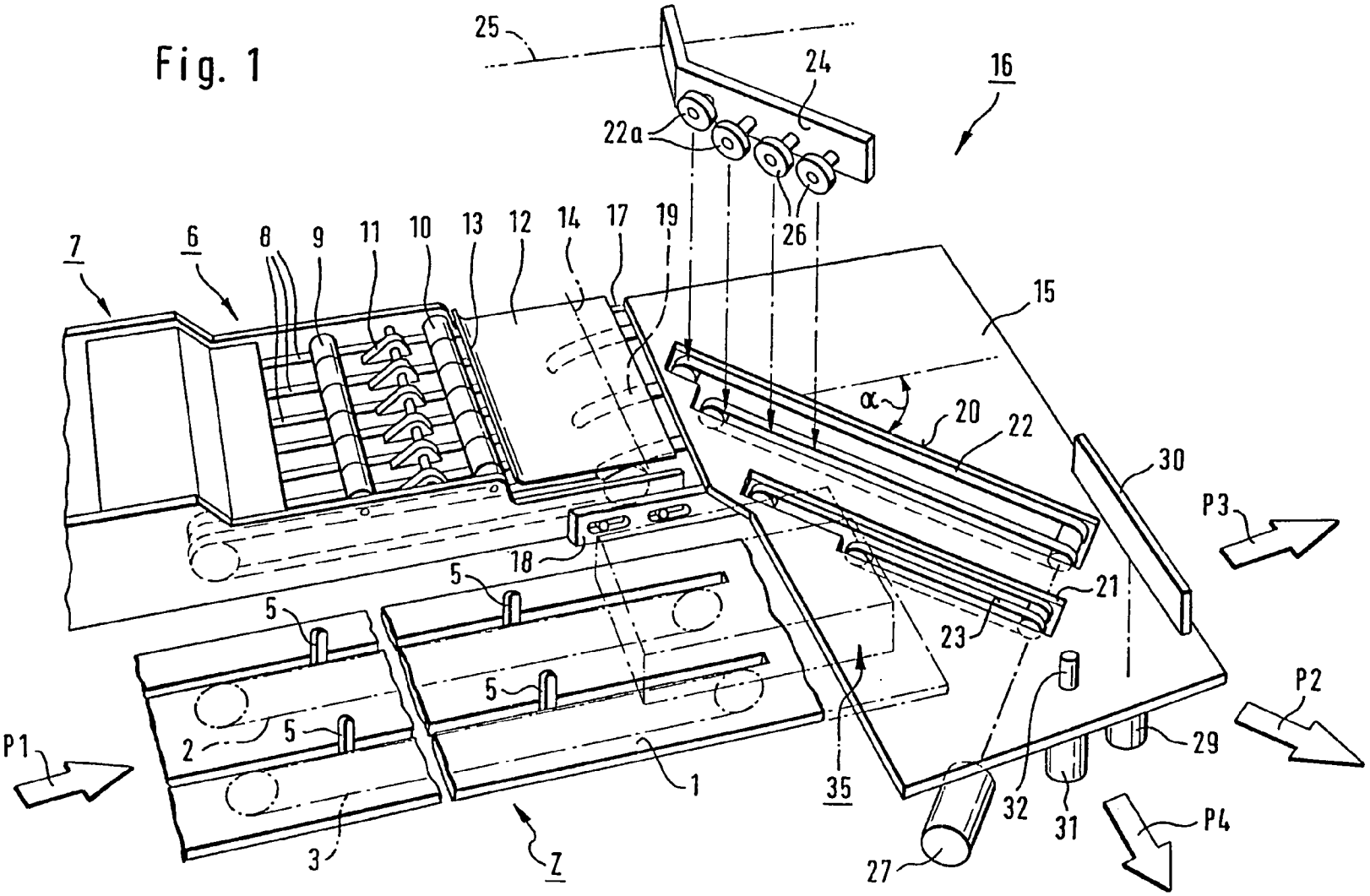
FIG. 1 is a schematic perspective illustration of an envelope-filling station for mail-processing systems in a partially disassembled state.

Underneath a conveying path plate 1, the envelope-filling station according to FIG. 1 contains endless, circulating conveying chains 2 and 3 that are supported and driven in a known way and that are provided in the generally known way with conveying fingers 5 so that conveying finger pairs that are adjacent to each other and that project beyond the conveyor belt plate 1 from the particular top strand of the conveying chains define enclosure-conveying compartments along the course of the feeding device Z formed by the conveying chains, into which enclosures or sets of enclosures can be inserted and moved towards the envelope-filling station in the direction of arrow P1. The drive of the conveying chains 2 and 3 can work intermittently or continuously.

Extending parallel to the feeding device Z for the enclosures or sets of enclosures and alongside the feeding device is an envelope-conveying device that is generally designated by 6 in FIG. 1. The envelope-conveying device 6 connects to an envelope-separating arrangement 7, in which a sequence of separated envelopes is created in a known manner from an envelope stack consisting of envelopes fed in standing on edge. The envelope-conveying device 6 receives this sequence of separated envelopes and transports them further lying essentially flat on a horizontal plane on a group of endless, circulating driving belts 8 that are guided on track rollers and driven rollers, whereby the envelopes to be transported are loaded on their top sides by pinch rollers or pressing rollers 9 and 10 and are held in frictional contact on the top strands of the driving belts 8.

Located between the pinch rollers or pressing rollers 9 and 10 is an envelope flap-opening station 11, which is only shown schematically in FIG. 1 and which first brings causes the closed leading edge of an envelope to run through under the pressing roller 9, the envelope flap-opening station 11 and the pressing roller 10, but then the envelope flap, which at first is still lying above the envelope opening, catches under the backward-pointing fingers of the envelope flap-opening station, and the envelope is conveyed forward by the conveying belts 8 and the pressing roller 10 with its flap opened and lying flat.

The opened envelopes are conveyed in under a cover plate 12 by the conveying belts 8 and by the pressing roller 10. To make this easier, the cover plate 12 can exhibit an upward bend 13 at its upstream edge. The cover plate 12, which is preferably adjustably mounted to the frame of the envelope conveying device 6, brings about that the part of a conveyed envelope that has left the nip space between the conveying belts 8 and the pressing roller 10 is gently held in position at the top strands of the conveying belts 8, whereby at the border indicated by the dot-dash line 14, the conveying belts 8 run around rollers and are directed back underneath the cover plate.

Before the end of the envelope-conveying device 6 and the end of the conveying path plate 1 of the feeding device is an intermediate envelope-conveying table 15 of an intermediate envelope-conveying device 16. Below the level of the table, this intermediate envelope-conveying table 15 is provided with mounting cheeks 17 and 18 which run parallel to the conveying direction of the envelope-conveying device 6 and by means of which the intermediate envelope-conveying table 15 can be pulled away from or pushed toward the envelope-conveying device 6 parallel to the conveying direction of the envelope-conveying device 6 in order to adjust to various envelope formats, and can be fixed in the particular position.

From the intermediate envelope-conveying table 15 edge that is adjacent to the envelope-conveying device 6, tongues 19, which are preferably elastically designed, project in a direction opposite to the conveying direction of the envelope-conveying device 6 in each of the spaces between the conveying belts 8 underneath the cover plate 12, in such a way that an envelope conveyed through underneath the cover plate 12 on the top strands of the conveying belts 8 arrives with its leading edge securely at the level of the intermediate envelope-conveying table 15.

It is significant that the leading edge, oriented at least essentially transverse to the conveying direction of the envelope-conveying device 6, of a conveyed envelope reaches the intermediate envelope-conveying table 15 when the trailing parts of the envelope, including the envelope flap, have already left the nip space between the top strands of the conveying belts 8 and the pressing roller 10, the envelope is now being held in position on the top strands of the conveying belts 8 only through being supported on the cover plate 12, and thus continues to move in the conveying direction of the envelope-conveying device 6. The importance of this design of the end section of the envelope-conveying device 6 adjacent to the intermediate envelope-conveying device 16 comes from the following considerations.

Located in the intermediate envelope-conveying table 15 are elongated cutouts 20 and 21, which begin in the vicinity of the cover plate 12 of the edge of the intermediate envelope-conveying table 15 that is adjacent to the envelope-conveying device 6 and run approximately diagonally over the surface of the intermediate envelope-conveying table 15. The angle of the central longitudinal axis of the cutouts 21 and 22 is designated by $\alpha$ and lies in the range from 15° to 75°, whereby an angle range from 40° to 50° is preferred. The top strands of endless, circulating conveying belts 22 and 23 that are guided on track rollers and driven rollers rise through the openings of the elongated cutouts 20 and 21 slightly above the level of the intermediate envelope-conveying table 15.

At the location where the conveying belts 22 begin in two groups that are adjacent to each other and run parallel near the downstream edge of the cover plate 12 and are directed over the corresponding track rollers and are supported by same, standing opposite them are abutment rollers 22*a*, which are rotatably mounted on a support 24, whereby the support 24 is in turn supported on a frame of the intermediate envelope-conveying device 16 so it can swing up around a pivot axis 25. It should be noted here that the support 24 with the abutment rollers 22*a* in FIG. 1 is shown lifted from the lower machine parts, in practice, however, is mounted lowered onto the conveying belts 22 of the intermediate envelope-conveying device 16.

It is also significant that the axes of rotation of the abutment rollers 22*a* and additional abutment rollers 26 supported on the support 24, just like the axes of rotation of the track rollers of the conveying belts 22 and 23 and the axes of rotation of the drive rollers that are coupled with the drive 27, all have an orientation orthogonal to the central longitudinal axes of the elongated cutouts 20 and 21, i.e., all are at an angle of +90° relative to the conveying direction of the envelope-conveying device 6 relative to a projection onto the level of the intermediate envelope-conveying table 15.

As a result of the fact that the track rollers placed at the beginning of the elongated cutout 20 and the conveying belts laid 22 over them along with the particular abutment rollers 22*a* on the support 24 form a clamping nip which, in mutual interaction with corresponding roller pairs, has a course parallel to the end edge of the cover plate 12, i.e., perpendicular to the conveying direction of the envelope-conveying device 6, the interacting roller pairs, with the cooperation of the top strands of the conveying belts 22, simultaneously grip the leading edge of an envelope forwarded by the envelope-conveying device 6, which, however, is no longer gripped in a clamping nip between conveying belts 8 and pressing roller 10, but is instead conveyed forward by the top strands of the conveying belts 8 while lying gently at the underside of the cover plate 12, in such a way that the envelope can execute a movement component horizontally transverse to the conveying direction of the envelope-conveying device 6, since, as was mentioned earlier, the interacting roller pairs of the intermediate envelope-conveying device 16 have an orientation of their axes of rotation at an angle of +90° relative to the conveying direction of the envelope-conveying device 6. The interacting roller pairs and the conveying belts 22 thus immediately pull the forwarded envelope in a direction over the surface of the intermediate envelope-conveying table 15.

While an envelope is transported from the intermediate envelope-conveying device 16 comparatively firmly coupled with its driving means in a beginning section of the intermediate envelope-conveying device 16, namely, in the section defined by the abutment rollers 22*a* and 26, this coupling becomes increasingly looser in a region placed approximately before the end of the conveying path plate 1 in such a way that in the embodiment shown in FIG. 1, only the own weight of an envelope transported by the intermediate envelope-conveying device 16 is now maintaining the friction to the conveying belts 22 and 23, and the conveyed envelope can now be displaced in its plane relative to the intermediate envelope-conveying device by overcoming relatively low frictional forces.

Provided at the end of the intermediate envelope-conveying device 16 at a position opposite the end of the conveying path plate 1 is an angled stop arrangement that consists of a stop straightedge 30 that can be lowered by means of a drive 29 and a stop pin 32 that can be lowered by means of a drive 31. A common actuating drive can also be provided for the stop straightedge 30 and the stop pin 32. When the stop straightedge 30 and the stop pin 32 are raised above the level of the intermediate envelope-conveying table 12 [sic] as is shown in FIG. 1, the angled stop arrangement is switched to the active state. Switching to the inactive state can provide either the lowering of both the stop straightedge 30 and the stop pin 32, or it can also take place in such a way that either the stop straightedge 30 or the stop pin 32 alone is switched to the inactive state, i.e., is lowered in the present example, depending on whether, after an envelope conveyed by the intermediate envelope-conveying device 16 has run up against the angled stop, a removal in the oblique direction corresponding to arrow P2 or parallel to the conveying direction of the envelope-conveying device 6, corresponding to arrow P3, or perpendicular to this corresponding to arrow P4 takes place.

Let it be noted that after an envelope conveyed by the intermediate envelope-conveying device 16 has run up against the angled stop arrangement, a bringing to rest of the conveying belts 22 and 23 does not necessarily have to take place, but in fact they can be kept in circulation by means of the drive 27 so that an envelope arriving at the angled stop arrangement remains in the alignment position at the stops. An additional fixing of the aligned envelope on the surface of the intermediate envelope-conveying table 15 can also be provided, for example, by a vacuum suction arrangement or something similar.

Figure 2:
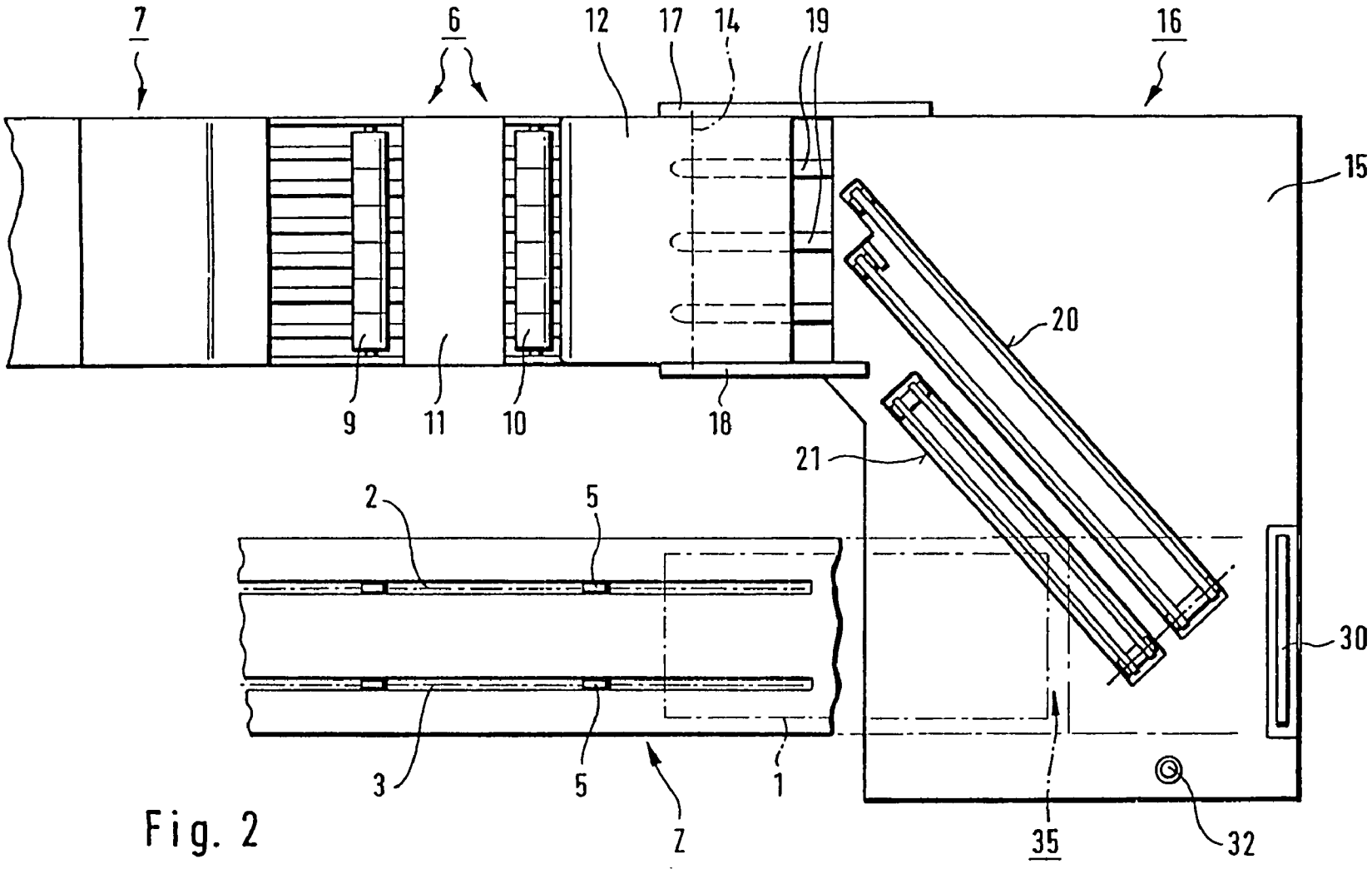
FIG. 2 is a greatly simplified representation in a plan view of part of an envelope-conveying device and an associated intermediate envelope-conveying device of the envelope-filling station according to FIG. 1.

From FIG. 1 and from FIG. 2, in the latter of which parts that are identical to the representation in FIG. 1 have of course been provided with the same reference symbols as well, it can be seen that the conveying path plate 1 of the feeding device Z does not end, for example, at its end at the opposite edge of the intermediate envelope-conveying table 15, but rather, as is shown in the dot-dash lines, it is located at a somewhat higher level than the plane of the intermediate envelope-conveying table 15 and it extends for a certain distance above the level of the top side of the intermediate envelope-conveying table 15. The level of the conveying path plate 1 approximately corresponds to the level of the cover plate 12 of the envelope-conveying device 6. The importance of this arrangement will be explained below.

In any case, however, the feeding device conveying chains 2 and 3 fitted with the conveying fingers 5 are turned around at the front end, relative to the conveying device, of their circulation and ahead of the edge of the intermediate envelope-conveying table 15 by the chain wheels allocated to them, whereby slots in the conveying path plate 1 that also run longitudinally end far enough ahead of the edge of the intermediate envelope-conveying table 15 in all possible adjustment positions of the intermediate envelope-conveying device 16 in such a way that during circulation of the conveying chains 2 and 3, the conveying fingers 5 lower below the level of the conveying path plate 1 undisturbed by the position of the intermediate envelope-conveying device, and are able to return to the start of the feeding device.

It can be seen that an envelope with opened envelope flap conveyed by the conveying belts 22 and 23 of the intermediate envelope-conveying device 16 against the angled stop arrangement 30, 32 is pulled from the space underneath the cover plate 12 and is conveyed with its trailing part, including the opened envelope flap, into the nip space between the top side of the intermediate envelope-conveying table 15 on the one hand and the part of the conveying path plate 1 that overlaps same, so that finally, when the envelope has run up against the angled stop arrangement and is aligned in its precise position, the envelope flap remains essentially entirely underneath the conveying path plate 1, but the upper wall of the envelope can be pulled up, for example, by means of a suction cup arrangement or similar devices, in the region between the front edge of the conveying path plate 1 and the stop straightedge 30 in order to ready the envelope opening for filling with an enclosure or set of enclosures.

The conveying path plate 1 can be provided in its forward region, which is not shown in the drawing, however, with a slight upward bend along the edge facing the envelope-conveying device 6 in order to facilitate the pushing-in of envelope parts and envelope flaps into the nip space between the conveying path plate 1 and the top side of the intermediate envelope-conveying table 15, similar to the function that was described in connection with the upward bend 13 of the cover plate 12.

The pushing-in of the enclosures or sets of enclosures into the opened, readied and precisely positioned envelope takes place by means of a push-in arrangement 35, which is shown in FIGS. 1 and 2 in the form of a block symbol in dot-dash lines. The push-in arrangement 35 has a design that exhibits sets of push-in fingers that reach from above down to the level of the top side of the conveying path plate 1 when they are in an operating stroke in the conveying direction of the feeding device, whereby the routes of the push-in fingers of the push-in arrangement 35 in the operating stroke alongside or between the paths of the conveying fingers 5 run in such a way that in the operating stroke, the push-in fingers of the push-in arrangement 35 take an enclosure or set of enclosures from its position in front of a pair of conveying fingers 5 of the feeding device and, in the course of the operating stroke, then push it into the opened envelope. If the feeding device Z is working continuously, the speed of the push-in fingers of the push-in arrangement 35 during the operating stroke is selected in such a way that the push-in fingers overtake the conveying finger pair 5 and in this way produce an adequate distance between the conveying finger pair and the trailing edge of the enclosure or set of enclosures so that they conveying fingers have the opportunity to drop below the level of the conveying path plate 1 at the front end of their top track without disturbing the operation. Once the enclosure or set of enclosures has been pushed into the envelope, the push-in fingers are raised above the level of the conveying path plate and in a return stroke are returned to a starting position.

Push-in arrangements that fulfill these functions are known in many kinds of embodiments.

For example, the push-in fingers can have the shape of lugs on endless, circulating belts that are directed over driven rollers and track rollers in such a way that at the end of the operating stroke, the lugs are directed above the front rollers in the push-in direction and along the particular top strand of the belts back into the starting position, in which a lowering of the outer lug ends to the level of the top side of the conveying path plate again takes place.

Other known push-in arrangements contain three-link guide-bar mechanisms for the straight-line guiding of a shaft that is supported on a back and forth swinging carrier of the three-link mechanism in order to support push-in fingers that can pivot and can thus be lowered onto the surfaces of the conveying path plate and lifted therefrom during the return stroke.

Although, to the extent that they correspond to known designs, the details of the push-in arrangement 35 do not form a part of the present invention, such a push-in arrangement in accordance with an advantageous further development suggested here can be designed in such a way that its operating stroke is given larger dimensions than necessary for completely pushing an enclosure or set of enclosures into the envelope that has run up against the angled stop arrangement and has been aligned. After the angled stop arrangement has been lowered or switched to the inactive state, the end of the operating stroke of the push-in arrangement 35 then serves to push the filled envelope into the sphere of action of an envelope-advancing device which removes the envelope either in a direction along arrow P3 or along a direction corresponding to arrow P2 of FIG. 1. For the removal of the filled envelope in the direction of arrow P3 in FIG. 1, all that is needed is to switch the stop straightedge 30 to the inactive state or to lower it.

From the preceding explanations in connection with FIGS. 1 and 2, it can be seen that an envelope conveyed by the envelope-filling station suggested here departs from a firm clamping for prevention of envelope movements in the envelope plane transverse to the conveying direction for a first time as soon as the trailing edge of the opened envelope flap has passed under the abutment roller 10, after which a new firm clamping of the envelope for prevention of lateral movements transverse to the new conveying direction takes place when the leading edge of the envelope has arrived at under the abutment rollers 22*a* of the support 24, which are prestressed against the conveying belts 22. However, this firm clamping of the envelope is increasingly loosened when the envelope now passes under the abutment rollers 26 and finally comes completely free of the abutment rollers of the support 24. In any event, the envelope finally arrives in its precise position when it runs up against the angled stop arrangement. Side guides are not necessary on the envelope conveying path that has just been outlined. No operational malfunctions occur, even at elevated working speeds.

Figure 3:
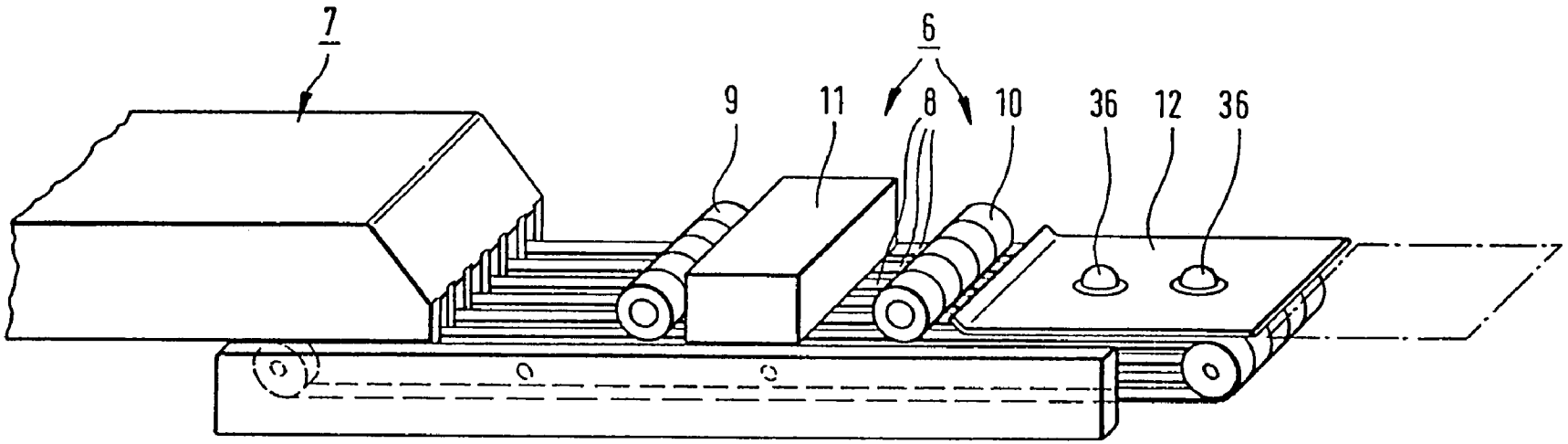
FIG. 3 is a schematic perspective view of an envelope-conveying device and an envelope-separating arrangement showing a modification of FIG. 1.

If, in the case of certain envelope materials or certain envelope formats, it should turn out that the gentle holding down of the envelope by the hold-down plate or pressure-exerting plate 12 is not sufficient to produce the friction of the bottom of the envelope against the top strands of the conveying belts 8 of the envelope-conveying device that is needed for reliable conveying, then according to a modification shown in FIG. 3, the hold-down plate 12 can be provided with cages for spherical rolling bodies 36 that exert a certain pressing force on the envelope that is passing between the top strands of the conveying belts 8 and the underside of the hold-down plate 12, without substantially hindering a lateral movement transverse to the conveying direction of the conveying belts 8 when the leading edge of the envelope is in engagement with the conveying nip between the conveying belts 22 of the intermediate envelope-conveying device 16 and the pressing rollers 22*a* of the support 24.

According to a modification, not shown, suitable spherical rolling bodies with associated guide cages can also be provided on a suitable extension of the support 24 in order to bring about the frictional forces between the underside of the envelope and the top strands of the conveying belts 22 and 23 on the envelope conveying route of the intermediate envelope-conveying device 16 until it runs up against the angled stop arrangement, without blocking a transverse movement relative to the conveying direction of the intermediate envelope-conveying device.

Figure 4:
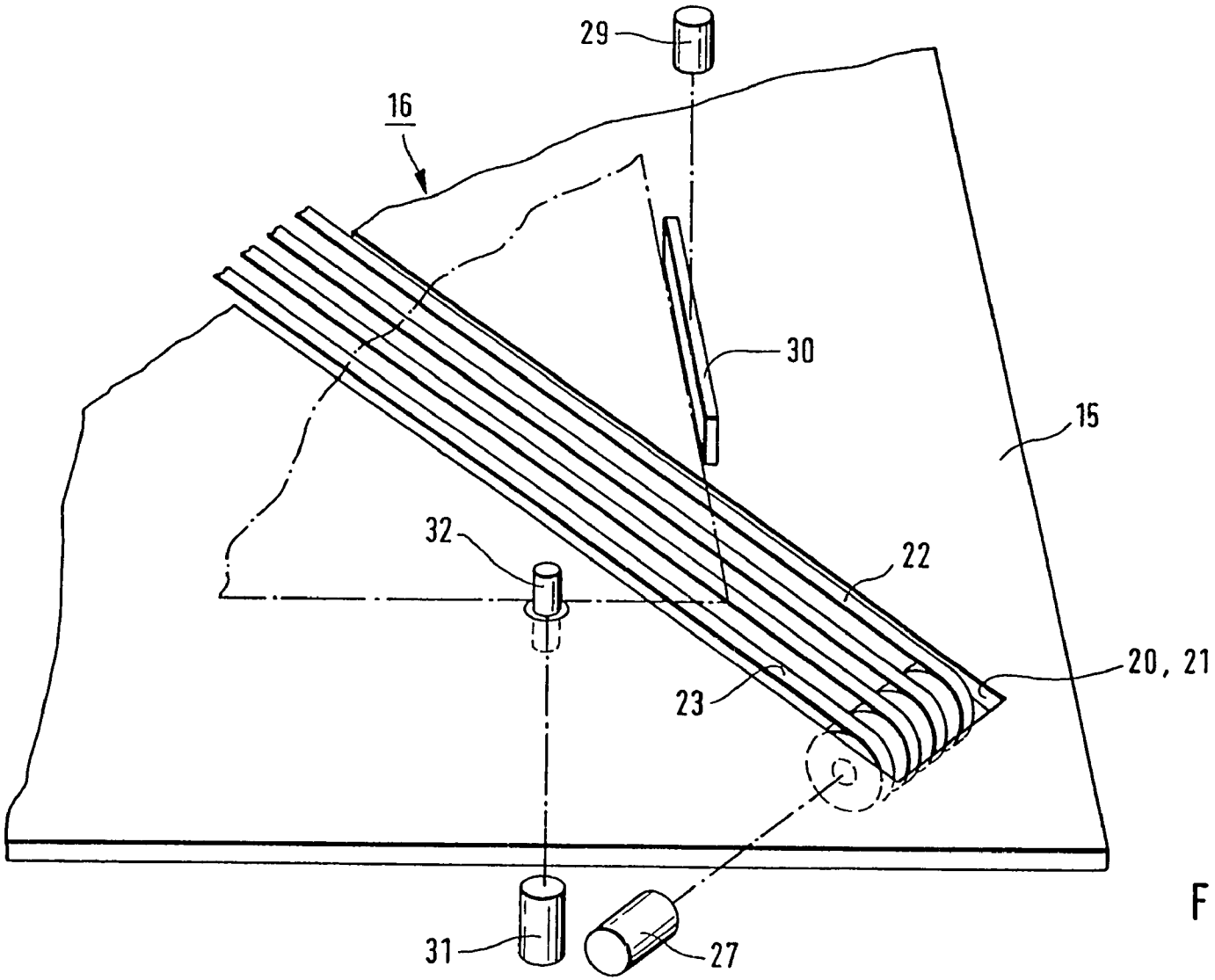
FIG. 4 is a perspective detail representation of the intermediate envelope-conveying device in a modification of FIGS. 1 and 2.

FIG. 4, in which parts corresponding to those in FIGS. 1 and 2 are again provided with the same reference symbols, shows a modification of the intermediate envelope-conveying device 16, whereby the cutouts 20 and 21 that run obliquely and the conveying belt arrangements with the conveying belts 22 and 23 are extended beyond the region of the angled stop arrangement. In the embodiment of the intermediate envelope-conveying device 16 shown in FIG. 4, its conveying means can thus be used, after the envelope has been filled and the angled stop arrangement has been switched to the inactive state, to remove the filled envelope in the direction corresponding to arrow P2 of FIG. 1 in such a way that part of the conveying means of the intermediate envelope-conveying device 16 can be used at the same time as an envelope-advancing device.

In the same way as with the embodiment according to FIGS. 1 and 2, the drive motor 27 for moving the conveying belts 22 and 23 can also be kept in operation while the envelope is located in its precise position in front of the push-in arrangement 35 after having run up against the angled stop arrangement, which, first, simplifies the control functions, and second, prevents the envelope from springing back from the stops of the angled stop arrangement and losing its precise positioning, for example, before the fixing means that hold a positioned envelope firmly against the surface of the intermediate envelope-conveying table 15 take effect.

Figures 5, 6:
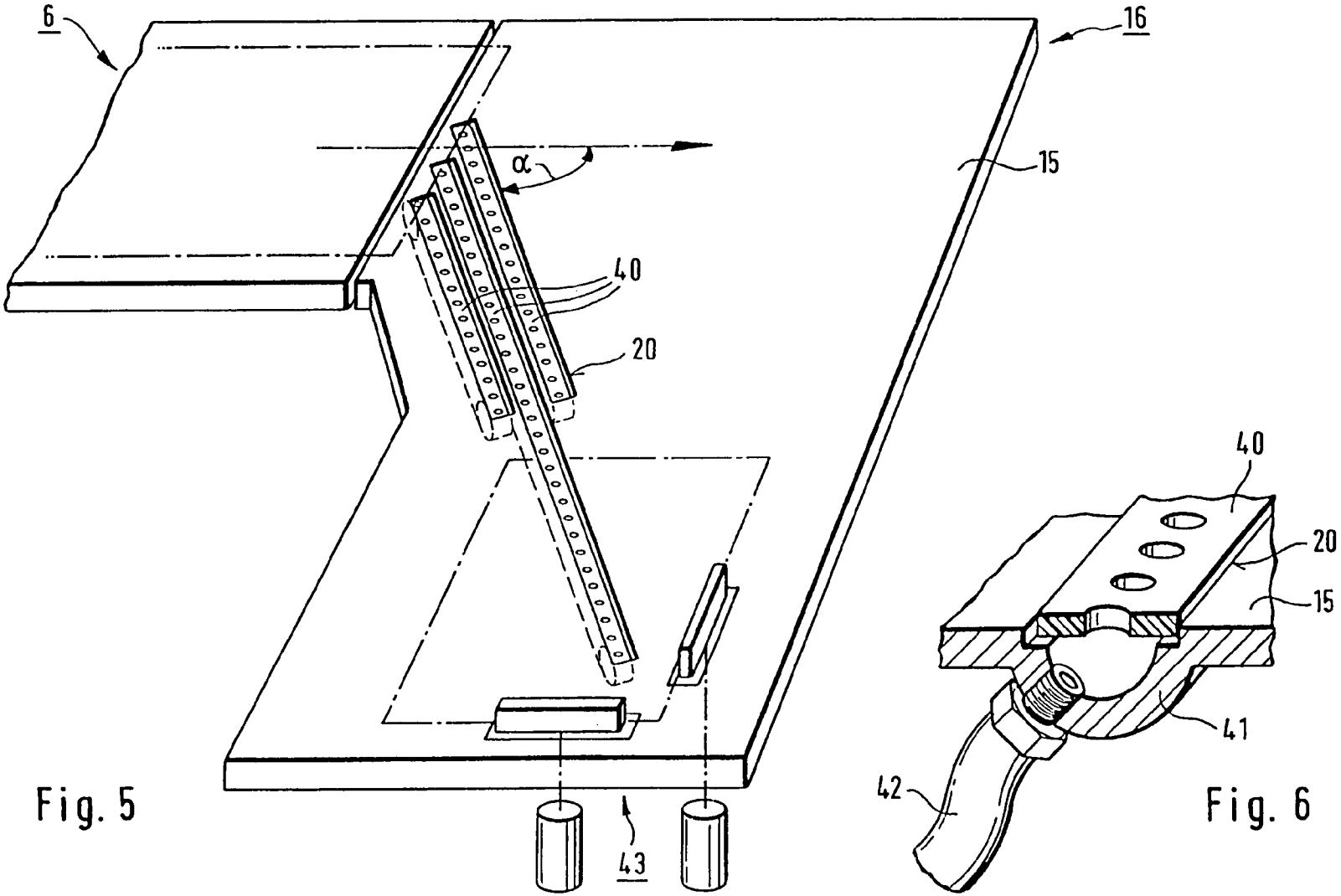
FIG. 5 is a schematic perspective representation of part of the envelope-conveying device and the intermediate envelope-conveying device, which is in turn a modification of the design according to FIGS. 1 through 4.
FIG. 6 is a perspective detail view, partly shown in cross section, of conveying means of the intermediate envelope-conveying device according to FIG. 5.

FIGS. 5 and 6 illustrate a form of intermediate envelope-conveying device 16, which is modified from the previously described embodiments and which can be used between an envelope-conveying device 6 and a feeding device Z for enclosures or sets of enclosures, e.g., according to FIG. 1. The intermediate envelope-conveying device 16 can be provided with a support 24, which is supported on its frame so that it can pivot around an axis that is parallel to the conveying direction of the envelope-conveying device 6, and on which abutment rollers 22*a* can be mounted with the alignment of their axes of rotation at an angle of +90° relative to the conveying direction of the envelope-conveying device 6, as was described in connection with FIG. 1. However, the pivoting support 24 with the abutment rollers has been left out of FIG. 5 for the sake of simplifying the illustration. It should be noted that even with a practical embodiment of the intermediate envelope-conveying device 16 according to FIG. 5, a pivoting support 24 with abutment rollers can be completely dispensed with in certain cases, as will be seen from the further description of the embodiment according to FIG. 5.

The intermediate envelope-conveying table 15 according to FIG. 5 also contains elongated cutouts 20, the central longitudinal axis of which is horizontally oriented at an angle relative to the conveying direction of the envelope-conveying device 6. Unlike the embodiment according to FIG. 1, however, it is not the particular upper strands of conveying belts, designated by 22 and 23 in FIG. 1, that rise from these cutouts above the level of the top of the intermediate envelope-conveying table 15, but rather the particular upper strands of perforated, endless conveying belts 40 that are guided over track rollers and drive rollers, whereby underneath the particular top strand of a perforated conveying belt 40, for example, directly tightly adjoining the envelope-conveying table 15 as shown in FIG. 6, vacuum chambers 41 that can be supplied with a vacuum by means of vacuum connections 42 are provided extending along the conveying belts.

Lying next to each other in a horizontal plane, top strands of the perforated conveying belts 40 begin near a line that is parallel to the conveying direction of the envelope-conveying device 6 and adjacent to the corresponding edge of the intermediate envelope-conveying table 15, in such a way that when an envelope is conveyed out of the envelope-conveying device 6 by gentle clamping between its conveying means, the leading edge of the envelope in question is essentially simultaneously gripped and sucked tight by the vacuum openings of the perforated conveying belt top strands that lie next to each other, in such a way that the envelope in question is then drawn over the surface of the intermediate envelope-conveying table 15 in a direction at an angle relative to the conveying direction of the envelope-conveying device 6.

In a way that is analogous to the explanations in connection with FIGS. 1 and 2, a decreasing, in the conveying direction, fixing to the conveying means of the intermediate envelope-conveying device 16 of an envelope to be conveyed is obtained in the embodiment according to FIG. 5 in that either the number of adjacent, perforated conveying belts 40, as shown in FIG. 5, decreases in the conveying direction of the intermediate envelope-conveying device 16, so that finally, only a single perforated vacuum conveying belt is still active in the region of the angled stop arrangement, which is indicated generally here by 43, or also, in that several separate and individually suppliable vacuum chambers 41 are provided in the conveying direction of the intermediate envelope-conveying device 16, which are increasingly supplied with a weaker vacuum so it is assured that when an envelope conveyed in the intermediate envelope-conveying device 16 reaches the angled stop arrangement 43, the envelope can be moved to a sufficient extent and experiences a precise alignment relative to the conveying means of the intermediate envelope-conveying device when it runs up against the angled stop arrangement.

According to embodiments that are not shown in the drawing, the conveying means in the region of the envelope-conveying device 6 and/or the conveying means in the region of the envelope-advancing device can also contain perforated vacuum conveying belts in order to implement a removal of filled envelopes in the directions corresponding to arrows P2, P3 or P4. In any case, it should be noted with regard to the conveying means of the envelope-conveying device 6 that are designed as perforated vacuum conveying belts, that, either through control of the effective vacuum and/or through control of the number of adjacent, parallel, perforated vacuum conveying belts, they operate in such a way that they make possible in the end section a movement of the envelope with a movement component horizontally transverse to the conveying direction of the envelope-conveying device.

What is claimed is:

1. An envelope-filling station for mail-processing systems comprising:

a feeding device for horizontally feeding enclosures or sets of enclosures along a conveying path to a push-in arrangement;

an envelope-separating arrangement for separating envelopes from an envelope stack and for producing a sequence of separated envelopes;

an envelope-conveying device, having a conveying direction parallel to the conveying path, receiving the sequence of separated envelopes, for conveying the envelopes with envelope flaps trailing relative the conveying direction and having an end section providing a normal frictional force to contain a separated envelope in the end section such that the envelope can be moved with a horizontal movement component transverse to the conveying direction of the envelope-conveying device;

an intermediate envelope-conveying device receiving separated envelopes from the envelope conveying device and transporting them from the envelope conveying device to a push-in position proximal to the push-in arrangement and having a conveying direction running at an angle ($\alpha$) in the range of from 15 degrees to 75 degrees to the conveying direction of the envelope-conveying device, whereby the angled conveying direction is facilitated by the horizontal movement component allowed by the end section of the envelope conveying device, as the separated envelopes are removed from the end section; and an aligning means by which an envelope which is to be filled is positioned adjacent to the push-in arrangement.

2. The envelope filling station of claim 1 wherein the aligning means is comprised of an angled stop arrangement which can be selectively switched to an active or an inactive state and against which, in the active position, the envelope can be conveyed to align with the push-in arrangement and, once the envelope has been filled with an enclosure or a set of enclosures, the angled stop arrangement can then be switched to the inactive state such that the filled envelope can be conveyed away from the envelope-filling station by an envelope-advancing device.

3. The envelope filling station of claim 1 wherein the intermediate envelope-conveying device includes a transport mechanism that resists a movement component transverse to the conveying direction of the intermediate envelope-conveying device.

4. The envelope filling station of claim 3 wherein a section of the intermediate envelope-conveying device further includes a section adjacent to the push-in arrangement arranged such that a conveyed envelope can be displaced in its plane.

5. The envelope-filling station as claimed in claim 1, wherein the conveying direction of the intermediate envelope-conveying device differs from the conveying direction of the envelope-conveying device in the range of from 40 degrees to 50 degrees, in relation to the push-in arrangement.

6. The envelope-filling station as claimed in claim 1 wherein the envelope-conveying device runs through an envelope-flap-opening arrangement.

7. The envelope-filling station as claimed in claim 1 wherein the envelope-conveying device contains endless, circulating conveying belts arranged parallel to one another and upstream of the end section abutment rollers which each interact with the top strand of the conveying belts.

8. The envelope-filling station as claimed in claim 7 wherein the end section further comprises a housing-mounted abutment plate.

9. The envelope-filling station as claimed in claim 7 wherein the end section further comprises spherical rolling bodies which are guided in cages of a housing-mounted abutment plate.

10. The envelope-filling station as claimed in claim 1 wherein the envelope-conveying device contains endless, perforated conveying belts running over vacuum chambers.

11. The envelope-filling station according to claim 1 wherein the intermediate envelope-conveying device contains endless, circulating conveying belts which are arranged parallel to one another, and, in a region which is adjacent to the envelope-conveying device, abutment rollers which each interact with the top strand of said conveying belts and of which the axes of rotation are oriented orthogonally to the conveying direction of the intermediate envelope-conveying device.

12. The envelope-filling station as claimed in claim 11 wherein, in a downstream region, the intermediate envelope-conveying device has abutment means that interact with the top strand of the conveying belts and butt against the top side of the envelopes.

13. The envelope-filling station of claim 12 wherein the abutment means is a housing-mounted abutment plate.

14. The envelope-filling station of claim 12 wherein the abutment means is spherical rolling bodies which are guided in cages of a housing-mounted abutment plate.

15. The envelope-filling station according to claim 1 wherein the intermediate envelope-conveying device contains endless, perforated conveying belts running over vacuum chambers, in which case it is possible to adjust a vacuum such that proximal to the aligning means the conveyed envelope can be displaced in its plane relative to the intermediate envelope-conveying device, frictional forces being overcome in the process.

16. The envelope-filling station according to claim 15 wherein the number of perforated conveying belts running over vacuum chambers is reduced proximal to the aligning device, thereby facilitating overcoming of the frictional forces in the plane of the conveyed envelope.

17. The envelope-filling station according to claim 1 wherein the intermediate envelope-conveying device is controlled such that its conveying means are kept in operation even when the conveyed envelope has run up against the aligning means.

18. The envelope-filling station as claimed in claim 2 wherein the envelope-advancing device is formed by an extension of the conveying means of the intermediate envelope-conveying device beyond the region of the angled stop arrangement.

19. The envelope-filling station as claimed in claim 2 wherein the envelope-advancing device has a conveying direction which coincides with that of the feeding device.

20. The envelope-filling station as claimed in claim 2 wherein the envelope-advancing device has a conveying direction which runs transversely to the push-in direction of the push-in arrangement.

21. The envelope-filling station as claimed in claim 2 wherein once the angled stop arrangement has been switched to the inactive state, the push-in arrangement, by continuing its operation stroke following the push-in operation, causes the filled envelope to be passed on to the envelope-advancing device.

22. The envelope-filling station as claimed in claim 2 wherein the angled stop arrangement is formed by a stopping straightedge and a stopping pin.

23. The envelope-filling station as claimed in claim 1 wherein the intermediate envelope-conveying device has a table, of which a position relative to a framework of the envelope-conveying device can be adjusted horizontally in the conveying direction thereof.

* * * * *